US008282391B2

(12) United States Patent
Oda

(10) Patent No.: US 8,282,391 B2
(45) Date of Patent: Oct. 9, 2012

(54) BURNER

(75) Inventor: Hiroshi Oda, Nagoya (JP)

(73) Assignee: Paloma Industries, Limited, Nagoya-Shi (JP)

( * ) Notice: Subject to any disclaimer, the term of this patent is extended or adjusted under 35 U.S.C. 154(b) by 447 days.

(21) Appl. No.: 12/107,993

(22) Filed: Apr. 23, 2008

(65) Prior Publication Data

US 2008/0268393 A1 Oct. 30, 2008

(30) Foreign Application Priority Data

Apr. 27, 2007 (JP) ..... 2007-119828

(51) Int. Cl.
*F23D 14/62* (2006.01)

(52) U.S. Cl. ..... 431/354; 431/328; 431/329

(58) Field of Classification Search ..... 431/354, 431/328, 329; 239/548, 559, 553, 558, 566, 239/567, 568; *F23D 14/62*
See application file for complete search history.

(56) References Cited

U.S. PATENT DOCUMENTS

| | | | | | |
|---|---|---|---|---|---|
| 1,598,996 | A * | 9/1926 | Wheelock | 239/429 |
| 2,348,011 | A * | 5/1944 | Koppel | 239/552 |
| 3,199,571 | A * | 8/1965 | Koppel | 431/328 |
| 3,527,199 | A * | 9/1970 | Harwood et al. | 126/39 J |
| 3,817,689 | A * | 6/1974 | Capy | 431/349 |
| 4,541,407 | A * | 9/1985 | Sommers et al. | 126/39 E |
| 4,752,213 | A * | 6/1988 | Grochowski et al. | 431/328 |
| 4,810,188 | A * | 3/1989 | Kwiatek | 431/266 |
| 5,593,300 | A * | 1/1997 | de Gouville | 431/328 |
| 6,561,138 | B2 | 5/2003 | Kobayashi et al. | |
| 6,895,902 | B2 | 5/2005 | Kobayashi et al. | |
| 7,766,005 | B2 * | 8/2010 | Lee et al. | 126/39 J |
| 2007/0221142 | A1 * | 9/2007 | Garrabrant et al. | 122/14.1 |
| 2008/0182216 | A1 * | 7/2008 | O'Donnell et al. | 431/329 |

FOREIGN PATENT DOCUMENTS

| | | | |
|---|---|---|---|
| CH | 594 853 | | 1/1978 |
| CH | 594853 | A5 * | 1/1978 |
| CH | 594853 AS | * | 1/1978 |
| DE | 4208951 | A1 * | 9/1993 |
| DE | 94 09 247 | | 9/1994 |
| DE | 203 10 534 | | 9/2003 |
| EP | 0 055 911 | | 7/1982 |

(Continued)

OTHER PUBLICATIONS

Japanese Office Action dated.

*Primary Examiner* — Steven B McCallister
*Assistant Examiner* — Desmond Peyton
(74) *Attorney, Agent, or Firm* — Burr & Brown

(57) ABSTRACT

The object is to provide a burner capable of taking in sufficient primary air even though the size thereof is compact, and capable of being used as an all-primary air burner. A burner includes a mixing pipe to which a fuel gas and combustion air are supplied, a burner main body having a mixing chamber at a top end on a downstream side of the mixing pipe, and a burner head which is provided at an upper part of the burner main body while communicating with the mixing chamber and has first and second burner ports for ejecting mixed gas of the fuel gas and air for combustion mixed in the mixing chamber. The burner further includes an extension pipe in the burner main body protruding inside the mixing chamber being formed by extending the mixing pipe.

7 Claims, 6 Drawing Sheets

FOREIGN PATENT DOCUMENTS

| | | | | |
|---|---|---|---|---|
| EP | 0 427 650 | | | 5/1991 |
| EP | 468155 | A1 | * | 1/1992 |
| EP | 1 209 415 | | | 5/2002 |
| FR | 2 655 711 | | | 6/1991 |
| GB | 1 175 868 | | | 1/1970 |
| GB | 2025027 | A | * | 1/1980 |
| GB | 2 266 585 | | | 11/1993 |
| JP | 52-134136 | A1 | | 11/1977 |
| JP | 61-064723 | U | | 5/1986 |
| JP | 62-148310 | U | | 9/1987 |
| JP | 03122410 | A | * | 5/1991 |
| JP | 08-501853 | A1 | | 2/1996 |
| JP | 11-287410 | A1 | | 10/1999 |
| JP | 2001-304691 | A1 | | 10/2001 |
| NL | 7 503 775 | | | 9/1976 |
| NL | 7503775 | A | * | 9/1976 |
| WO | WO 2005078344 | A1 | * | 8/2005 |

* cited by examiner

A
B
C
D
1
2
3
4
5
6
7
8
9
10
11
12
13
14
15
16
17

BURNER

BACKGROUND OF THE INVENTION

This application claims the entire benefit of Japanese Patent Application Number 2007-119828 filed on Apr. 27, 2007, the entirety of which is incorporated by reference.

FIELD OF THE INVENTION

The present invention relates to a burner used for a gas combustion appliance such as a hot water storage type water heater.

DESCRIPTION OF THE BACKGROUND ART

A conventional burner includes a burner main body having a mixing pipe to which fuel gas and combustion air are supplied, and a mixing chamber provided at a top end on a downstream side of the mixing pipe. Further, the burner includes a burner head provided at an upper part of the burner main body while communicating with the mixing chamber and including a burner port for ejecting a mixed gas of the fuel gas and combustion air from the mixing chamber. For example, patent document 1 describes that a burner is used to heat hot and cold water and the like in a gas combustion appliance such as a hot water storage type water heater. The burner used in this patent document 1 is a Bunsen burner provided in a combustion chamber arranged below a hot water storage chamber. This burner includes a burner main body facing a top end of a gas nozzle and having a throat part taking in air for combustion, and a burner head placed on the burner main body and having intermittently burner ports there around.

Patent document 1: Japanese Unexamined Patent Publication No. 2001-304691

SUMMARY OF THE INVENTION

From a viewpoint to suppress generating NOx (nitrogen oxide) in a combustion gas, it is desirable that a burner is an all primary air burner taking in air which has more than the theoretical equivalence required for combustion as primary air. In the all primary air burner, the highest temperature of a flame can be decreased by all primary low-load combustion, and thus NOx generation can be suppressed.

In a case of an all-primary air burner, it is necessary to increase a diameter of the throat part of a burner main body and increase a length of a mixing pipe in order to take in a large amount of primary air. However, a large size of a burner cannot be used for a gas combustion appliance where only small installing space is available in a mixing chamber, such as a hot water storage type water heater. Further, since the width and depth of a mixing chamber is usually larger than the diameter of the mixing pipe, an eddy flow is generated when mixed gas flows into the mixing chamber from the mixing pipe and ejection energy of fuel gas is consumed. Thus, the force to take in the primary air is decreased, and mixing of the fuel gas with the primary air becomes insufficient.

An object of the present invention is to provide a burner capable of taking in sufficient primary air to mix with a fuel gas even though the size thereof is compact, and being used as an all-primary air burner.

In order to achieve the above-described object, a first aspect of the invention includes, in a burner main body, an extension pipe protruding into a mixing chamber formed by extending a mixing pipe.

A second aspect of the invention includes, in addition to the first aspect, an extension pipe where a protruded end of the extension pipe is cut to be inclined so as to have an upward opening. In this configuration, an amount of primary air is taken in more.

A third aspect of the invention includes, in addition to the first and second aspects, a burner head which is in a cylindrical shape having a plurality of burner ports bored on almost whole periphery of a side face of the burner head, and is provided right above the mixing chamber of the burner main body, in order to have a sufficient burner port area thereby smoothly supplying mixed gas.

A forth aspect of the invention includes, in addition to any one of the first to third aspects of the invention, an extension pipe which is provided by protruding an end part of an internal pipe inserted in and held by the mixing pipe towards the inside the mixing chamber in order to easily obtain the extension pipe.

According to the first aspect of the invention, due to the extension pipe being provided in the burner main body, a distance for mixing can be sufficiently secured inside the burner. Furthermore, since an eddy flow does not occur when the mixed gas flows into the mixing chamber from the mixing pipe, the necessary primary air can be taken in using ejection energy of fuel gas, and thus the fuel gas and air needed for combustion can be favorably mixed in the mixing chamber. Therefore, the burner can be used as an all-primary air burner which has a compact size as a whole.

According to the second aspect of the invention, in addition to the effect of the first aspect, a favorable extension pipe, in which the suction amount of the primary air is increased, can be obtained by cutting the opening in inclining shape so as to have an upward opening.

According to the third aspect of the invention, in addition to the effects of the first and second aspects, a sufficient burner port area as an all-primary air burner can be kept with the cylindrical burner head. Further, an ejection speed of the mixed gas from the burner port is decreased, and thus fluid resistance is be suppressed. In addition to this, the mixed gas can be smoothly, uniformly supplied from the mixing chamber to the burner head. Further, since a combustion face is the side face, material debris dropping from an upper side are not accumulated on the burner port.

According to the forth aspect of the invention, in addition to the effect of any one of the first to third aspects, the extension pipe can be easily provided using the internal pipe.

BRIEF DESCRIPTION OF THE DRAWINGS

FIG. 1A illustrates a plane view, FIG. 1B illustrates a front view, FIG. 1C illustrates a right side face and FIG. 1D is an enlarged view of D part of FIG. 1A;

DETAILED DESCRIPTION OF THE INVENTION

Embodiments of the present invention will be described below with reference to the drawings.

Figures 1A, 1B, 1C, 1D:
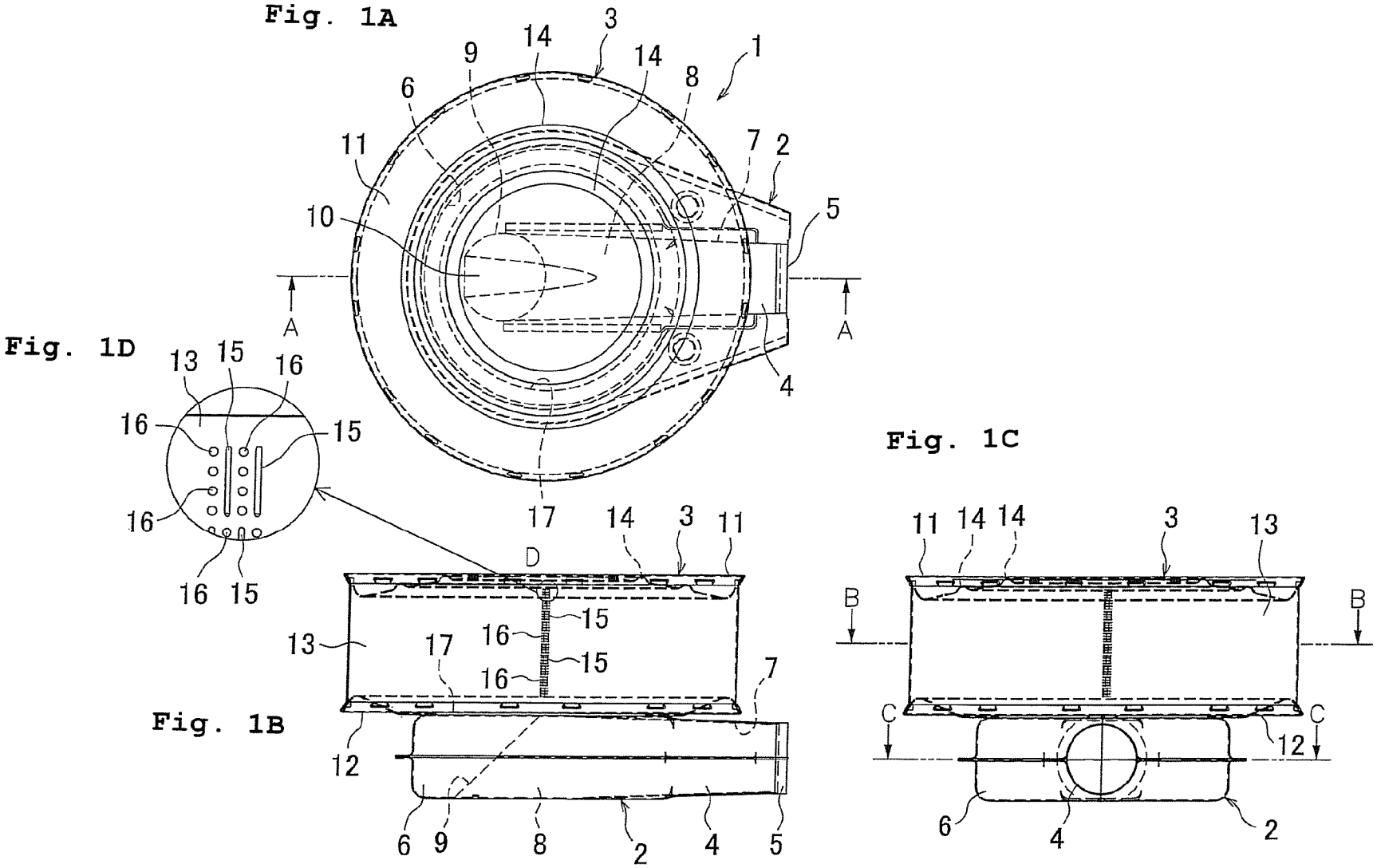
FIGS. 1A to 1D are descriptive views of a burner.

FIG. 1 are descriptive views of a burner, and FIG. 1A illustrates a plane view, FIG. 1B illustrates a front view, and FIG. 1C illustrates a right side face, respectively. A burner 1 includes a burner main body 2 on a lower side thereof, and a burner head 3 placed on the burner main body 2. The burner main body 2 includes a cylindrical mixing pipe 4 at an end part thereof, having a throat part 5, to which fuel gas and combustion air are supplied, and a round shaped mixing chamber 6 continuously provided at a downstream end of the mixing pipe 4. The burner main body 2 is formed with a pair of upper and lower metal plates which are bonded by caulking at a center thereof along the whole periphery. The mixing chamber 6 is a space having a radius larger than that of the mixing pipe 4, and continuously provided to the mixing pipe 4 in such a way that an axis line of the mixing pipe 4 in the horizontal direction is orthogonally crossed with an axis line of the mixing chamber 6 in a vertical direction.

Figure 2:
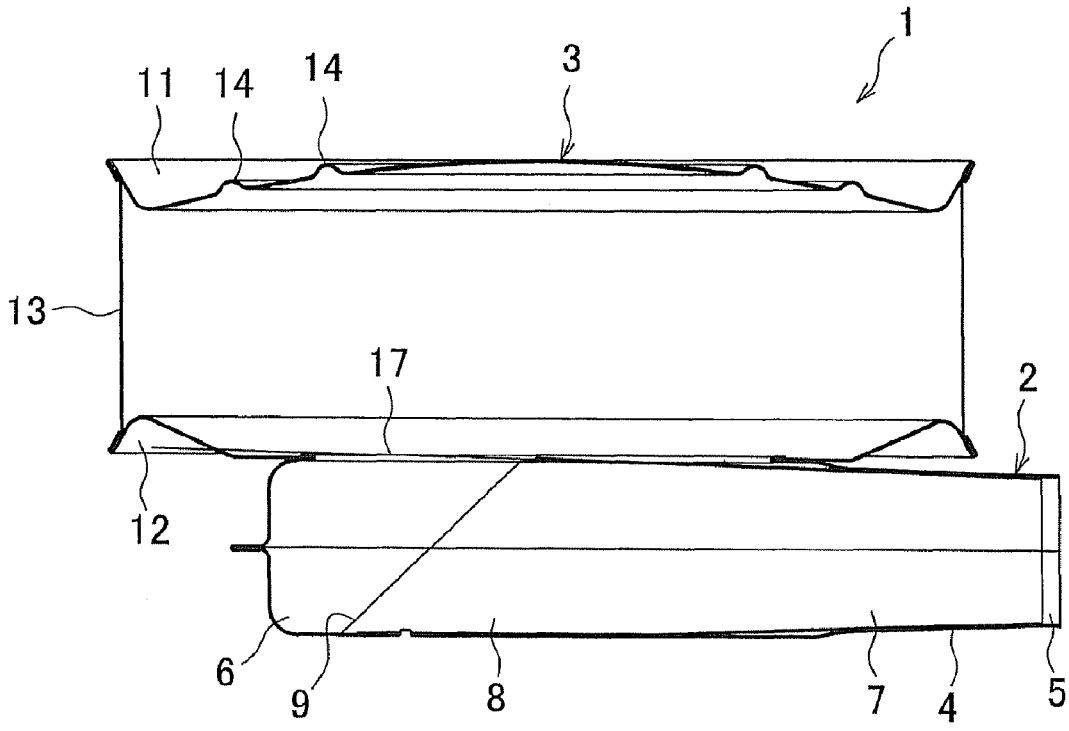
FIG. 2 is an enlarged cross sectional view taken along an A-A line.
Figure 3A:
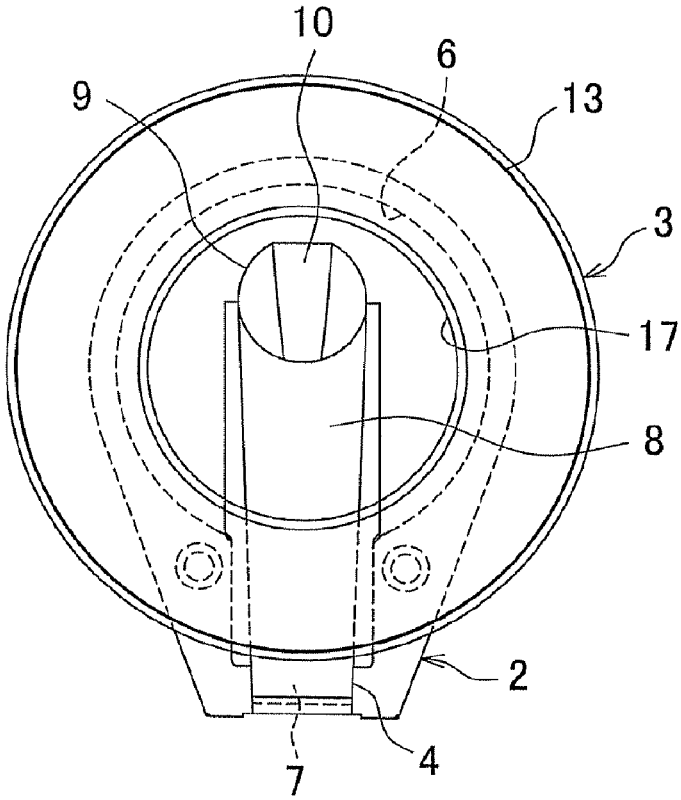
FIG. 3A is a cross sectional view taken along a B-B line.
Figure 3B:
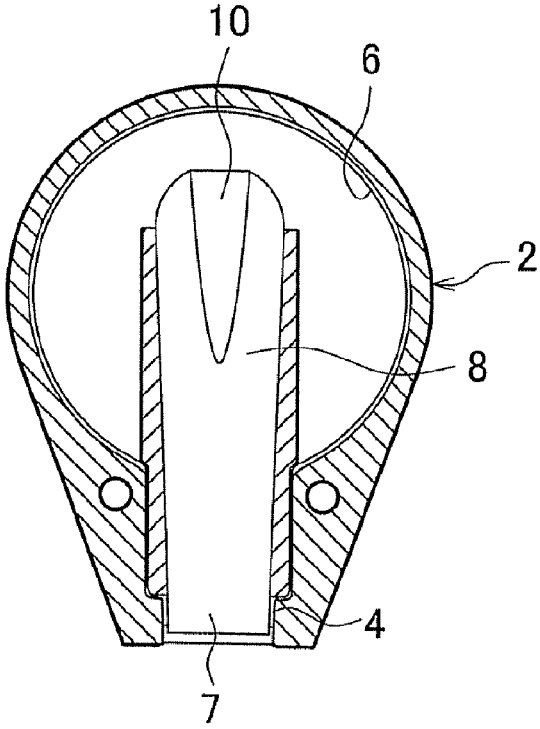
FIG. 3B is a cross sectional view taken along a C-C line.

Further, an internal pipe 7 is provided in the mixing pipe 4. As illustrated in FIGS. 2 and 3, the internal pipe 7 is a pipe, in which one end thereof is inserted in and held by the mixing pipe 4, and is formed with a pair of upper and lower metal plates which are bonded by caulking at the center of left and right side edges similar to the burner main body 2. The other end of the internal pipe 7 is protruded in the mixing chamber 6 in its diameter direction so as to be an extension pipe 8 to extend the mixing pipe 4. A protruded end of the extension pipe 8 is cut to be inclined so as to have an upward opening 9. A chamfered part 10 is provided at the bottom surface of the extension pipe 8 below the opening 9 for stabilizing the extension pipe 8 and comes into contact with the bottom surface of the mixing chamber 6.

Figure 4A:
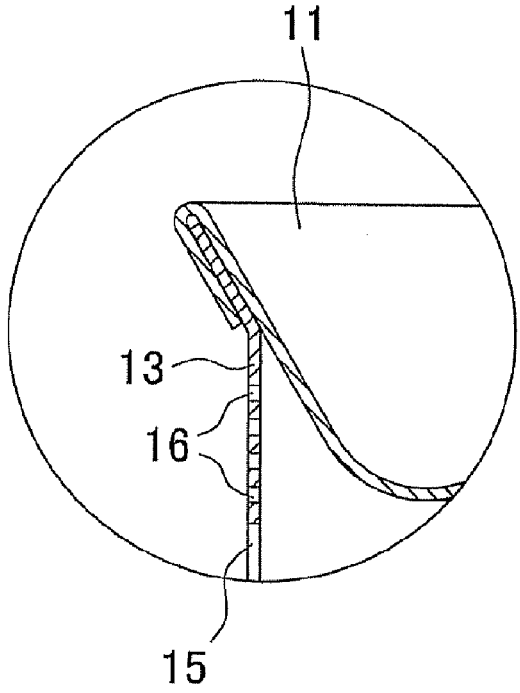
FIG. 4A is a descriptive view of a caulking part between an upper plate and a side plate.
Figure 4B:
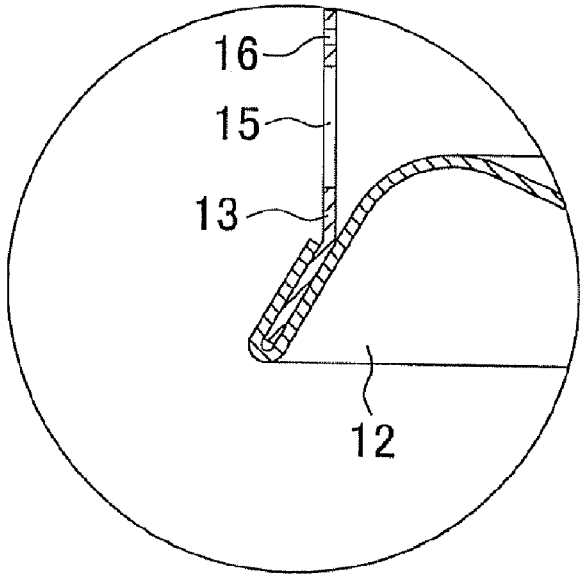
FIG. 4B is a descriptive view of a caulking part between a lower plate and a side plate.

On the other hand, the burner head 3 has cylindrical shape comprises an upper plate 11, a lower plate 12, and a side plate 13. The upper plate 11 and lower plate 12 have round shapes when viewed from a plane side, and the side plate 13 surrounds along peripheral edges of both the plates 11 and 12. As illustrated in FIGS. 4A and 4B, the burner head 3 is formed by folding back of the ends of upper and lower plates 11 and 12, clipping the upper and lower ends of the side plate 13 between them at the peripheral edges of the upper plate 11 and the lower plate 12 and being bonded by caulking. The upper and lower ends of the side plate 13 are bent to be outwardly enlarged. Further, ring-shaped ribs 14 and 14 having different diameters are concentrically formed on the upper plate 11 for absorbing deformation due to thermal stress.

Further, as illustrated in FIG. 1D where the D part in FIG. 1A is enlarged, a long slit-shaped first burner port 15 and a line of four circular second burner ports 16, 16, . . . are provided. The first burner port 15 is long in a vertical direction and the second burner ports 16, 16, . . . are lined up in the vertical direction. The first burner port 15 and the line of the second burner ports 16, 16, . . . are alternately arranged with each other in a peripheral direction and the vertical direction along almost the whole periphery (only a part thereof is illustrated in FIG. 1D). The reasons for using both the slit shaped and round shaped burner ports together is to have a burner port area of the slit-shaped first burner ports 15 with secured rigidity provided by the round second burner ports 16. Further, at the lower plate 12, a round communication hole 17 is provided. The communication hole 17 has an opening area almost equal to a total opening area of the first burner ports 15 and the second burner ports 16. A peripheral edge of the communication hole 17 is caulking bonded with an upper part of the mixing chamber 6 in the burner main body 2 to thereby co-axially position the burner head 3 right above the mixing chamber 6.

Figure 5:
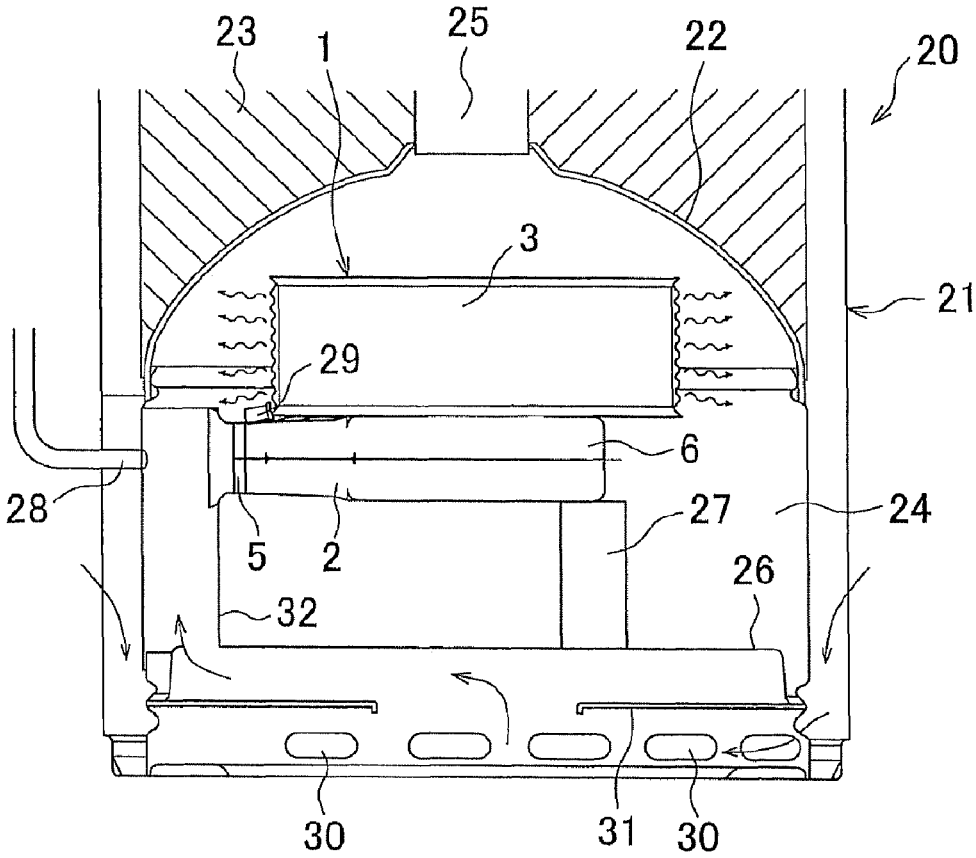
FIG. 5 is a descriptive view to illustrate a lower portion of a hot water storage type water heater.

For example, the burner 1 having the above-described constitution is used for a hot water storage type water heater 20 as illustrated in FIG. 5. This hot water storage type water heater 20 includes a hot water storage chamber 23 upper and lower sides of which are closed with an upper mirror plate (which are not illustrated) and a lower mirror plate 22, on the upper side of a cylindrical main body 21. The hot water storage type water heater 20 includes a combustion chamber 24 below the hot water storage chamber 23. The burner 1 is provided in the combustion chamber 24. In addition, a water supplying pipe to supply water into the hot water storage chamber 23 and a hot water supplying pipe to externally take out hot water from the hot water storage chamber 23 (both pipes are not illustrated) are provided on the upper side of the hot water storage chamber 23.

An exhaust pipe 25 is provided on the center of axle of hot water storage chamber 23, and this exhaust pipe 25 penetrates the hot water storage chamber 23 to be protruded toward an upper side of the main body 21. Through the exhaust pipe 25, combustion gas generated in the combustion chamber 24 is exhausted outside the main body 21. A baffle plate (not illustrated) having a spiral passage is provided inside the exhaust pipe 25.

The burner 1 is supported on a disc-shaped placing base 26 provided at a lower side of the combustion chamber 24 by a supporting plate 27. The throat part 5 of the burner main body 2 faces a gas nozzle 28 whose top end protrudes into the combustion chamber 24. The burner head 3 is positioned at a center of the combustion chamber 24. The reference numeral "29" indicates a pilot burner.

The burner 1 is supported by the supporting plate 27 so that the burner head 3 is protruded into a space covered by a lower mirror plate 22, and the side surface of the burner 1 faces the whole periphery of the hot water storage chamber 23.

Plural air feed ports 30, 30, . . . for air for combustion are arranged at predetermined intervals in the peripheral direction at the lower peripheral edge of the placing base 26. By means of the air feed ports, an inside of the placing base 26 is communicated with an external of the main body 21. Inside the placing base 26, a partition plate 31 which separates inside of the placing base 26 into upper and lower parts is provided. The partition has an opening at a center thereof. On the other hand, an air passage 32 in the upper and lower direction is provided on a gas nozzle 28 side of the combustion chamber 24, where the air passage 32 partitions the inside of the chamber combustion 24 while an upper space in the placing base 26 partitioned by the partition plate 31 is kept communicated with the throat part 5 of the burner main body 2. Thus, as indicated by an arrow, external air passes through the opening of the partition plate 31 and reaches to the air passage 32 after flowing into the placing base 26 from the air feed port 30. Then, the air goes up inside the air passage 32 to be introduced into the burner main body 2.

Therefore, in the hot water storage type water heater 20, when an ignition knob of a controller (not illustrated) provided at an external of the main body 21 is operated, a gas flow passage to the pilot burner 29 is opened and the pilot burner 29 is ignited. When the ignition is detected by a thermocouple (not illustrated), an electromagnetic valve of the gas flow passage is kept to be opened. In such a condition, when the ignition knob is operated to open a main gas flow passage, the fuel gas is ejected from the gas nozzle 28 to be supplied from the throat part 5 to the burner main body 2. By the ejection energy of the fuel gas, air outside the main body 21 is taken into the mixing pipe 4 of the burner main body 2 from the air feed port 30 through the inside of the placing base 26 and the air passage 32.

At this time, since the length from the throat part 5 to the opening 9 is sufficient with the extension pipe 8 protruding inside the mixing chamber 6, the fuel gas and the combustion air are properly mixed. In addition, the mixed gas ejected from the opening 9 collides with an inner surface of the mixing chamber 6, is divided into two directions, and reversely flows along the inner surface of the mixing chamber 6. Thus, the flow of the gas promotes the increased mixing of the fuel gas and the combustion air. Further, an eddy flow does not occur at the both sides of the extension pipe 8.

When the mixing chamber 6 is filled with the mixed gas, the mixed gas is supplied into the burner head 3 through the communication hole 17, and ejected from respective first and second burner ports 15 and 16 to be combusted. At this time, since the ejection speeds of the mixed gases from the burner ports 15 and 16 are low, the flame comes close to the burner ports 15 and 16 and surface combustion is carried out across almost the whole surface of the side plate 13, and thus temperatures of the burner ports becomes 800° C. or more. Further, since the whole surface of the cylindrical side face becomes a combusted surface, the influence of thermal stress can be suppressed.

The high temperature combustion gas generated by combusting the burner 1 goes up along a lower surface of the lower mirror plate 22, and passes through the central exhaust pipe 25 to be exhausted to outside of the main body 21. By the moving of the combustion gas, hot water in the hot water storage chamber 23 is heated by the lower mirror plate 22 and the exhaust pipe 25.

On the other hand, radiation heat generated by combustion at the side surface of the burner head 3 is radially emitted from the burner head 3 as illustrated with wavy arrows. However, since the whole side surface of the burner head 3 faces the hot water storage chamber 23, the radiation heat is effectively transmitted to hot water in the hot water storage chamber 23 to heat the hot water.

Since the radiation heat is effectively transmitted to the hot water storage chamber 23 as illustrated above, a temperature of the lower portion of the burner 1 in the combustion chamber 24 does not become high. Thus, the increase of the combustion air temperature from the air supply feed port 30 to the throat part 5 is suppressed. Therefore, a volume of the combustion air is not expanded, and a sufficient amount of primary air can be taken into the burner 1, which leads to the reduction of NOx generation.

As described above, according to the burner 1 of the above-described embodiment, the extension pipe 8 protruding inside the mixing chamber 6 is provided in the burner main body 2 by extending the combustion pipe 4 As a result, the mixing distance can be sufficiently kept inside the burner main body 2. In addition, since an eddy flow does not occur when the mixed gas flows into the mixing chamber 6 from the mixing pipe 4, the necessary primary air can be taken in using the ejection energy of the fuel gas, and the fuel gas and the combustion air can be favorably mixed in the mixing chamber 6. Therefore, the burner 1 can be suitably used as a primary air burner which has a compact size as a whole. More particularly, since the air of more than the theoretical equivalence required for combustion can be taken in as primary air by only the ejection energy of the fuel gas, the burner is a natural combustion type burner without using of a fan. Thus, the hot water storage type water heater 20 can be compacted which reduces cost.

Further, the protruded end of the extension pipe 8 is cut to be inclined so as to have the upward opening 9. Therefore, the suction amount of primary air is increased more. Further, the burner head 3 is in a cylindrical shape and has a plurality of first and second burner ports 15 and 16 bored at an almost whole periphery of the side face thereof and is provided right above the mixing chamber 6 of the burner main body 2. Thus, the sufficient burner port area can be provided as an all primary air burner as well as the ejection speed of the mixing gas from the first and second burner ports 15 and 16 decreases. Thus, fluid resistance is suppressed. In addition, the mixed gas can be smoothly, uniformly supplied from the mixing chamber 6 to the burner head 3. Further, since the side surface becomes a combustion surface, dropping materials from an upper side are not accumulated on the first and second burner ports 15 and 16.

On the other hand, because the extension pipe 8 is provided by protruding an end part of the internal pipe 7, which is inserted in and held by the mixing pipe 4, toward the inside of the mixing chamber 6, the extension pipe 8 is easily obtained.

In addition, in the above-described embodiment, the protruded end of the extension pipe is cut to be inclined so as to have the upward opening. However, the protruded end may be cut to be inclined so as to have a downward opening, or be cut in the vertical direction so as to have a sideways opening. In these cases, the amount of primary air which is taken in is increased compared to that is taken in by a burner main body not having an extension pipe.

Further, an extension pipe is not limited to the pipe using an end part of an internal pipe. An extension pipe can be provided by connecting only a portion corresponding to an extension pipe to an opening edge of a mixing pipe in a mixing chamber.

Figure 6A:
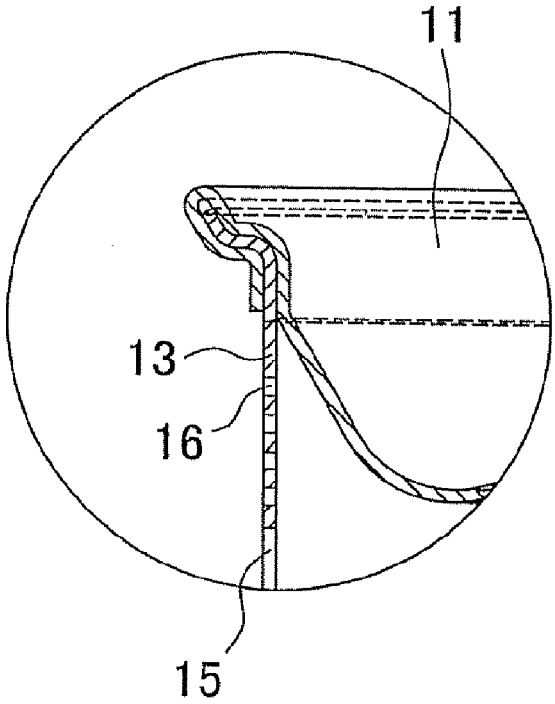
FIG. 6A is a descriptive view of a modified example of a caulking part between the upper plate and the side plate.
Figure 6B:
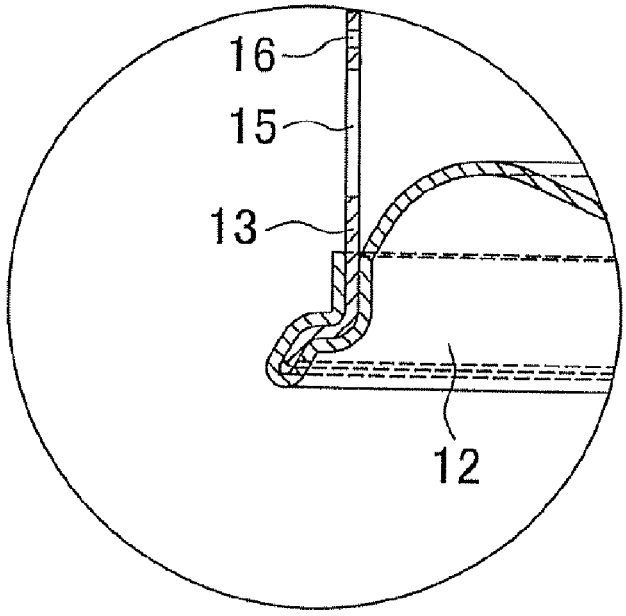
FIG. 6B is a descriptive view of a modified example of a caulking part between the lower plate and the side plate.

Furthermore, a burner port in a burner head is not limited to the burner port in the above-described embodiment. A size, a shape, an arrangement pattern and the like can be appropriately changed. The main body shape is not limited to a cylindrical shape, and may be other shapes such as a plate shape. Furthermore, caulking parts between the upper or lower plate and the side plate may be bent in a V shape toward the opposite side of the upper or lower plate as illustrated in FIG. 6, and with such a configuration, the strength is increased, and warping under thermal conditions can be effectively prevented.

Although the above-described embodiment describes a natural combustion type burner not using a fan, when combustion air is compulsively supplied using a fan, a structure using an extension pipe of the present invention can be used. That is, in this case, the effects for securing a mixing distance by an extension pipe, downsizing, and the like can be similarly obtained.

In addition, a burner of the present invention is not limited to the above-described hot water storage type water heater, and maybe used as heating means in the other gas combustion appliance such as a hot water supply appliance in which water passing through the inside of the appliance is heated by a heat exchanger.

What is claimed is:

1. A burner comprising:

a burner main body having a mixing pipe being supplied with a fuel gas and air for combustion, and provided with a mixing chamber at a downstream end side of the mixing pipe; and a burner head provided at an upper part of the burner main body while communicating with the mixing chamber, and having burner ports for ejecting a mixed gas of the fuel gas and combustion air mixed in the mixing chamber, wherein an extension pipe is protruded into the mixing chamber by extending the mixing pipe, wherein the extension pipe is positioned inside the mixing pipe and an end thereof extends through and beyond an end of the mixing pipe inside the mixing chamber, and wherein a bottom surface of said end of the extension pipe is flattened and said flattened surface is in contact with a bottom surface of the mixing chamber, whereby said contact between said flattened surface of the end of the extension pipe and said bottom surface of the mixing chamber prevents the extension pipe from rotating within the mixing chamber, wherein the protruded end of the extension pipe is cut to be continuously inclined, so as to have an upwardly extending opening.

2. The burner according to claim 1, wherein the burner head formed is a cylindrical shape having a plurality of burner ports bored on almost the entire periphery of a vertical side surface thereof, whereby said cylindrical shape is positioned right above the mixing chamber of the burner main body.

3. The burner according to claim 1, wherein the extension pipe is held by the mixing pipe inside the mixing chamber.

4. The burner according to claim 2, wherein the extension pipe is held by the mixing pipe inside the mixing chamber.

5. The burner according to claim 1, wherein the mixing chamber, from a top plan view, is formed in a shape that is substantially round.

6. The burner according to claim 5, wherein said cylindrical shape of the burner head, from a top plan view, is substantially centered and in communication with the center of the round mixing chamber.

7. The burner according to claim 1, wherein the mixing chamber has upper and lower internal edge corner surfaces, and wherein said upper and lower internal edge corner surfaces are formed into a substantially rounded convex shape.

* * * * *